United States Patent [19]

Schuegraf

[11] Patent Number: 4,700,154

[45] Date of Patent: Oct. 13, 1987

[54] POLARIZATION SEPARATING FILTER FOR HYPER FREQUENCY STRUCTURES

[76] Inventor: Eberhard Schuegraf, Mauthaeuslstrasse 15, D8000 Muenchen 70, Fed. Rep. of Germany

[21] Appl. No.: 844,128

[22] Filed: Mar. 26, 1986

[30] Foreign Application Priority Data

Mar. 27, 1985 [DE] Fed. Rep. of Germany ..... 3511127

[51] Int. Cl.[4] ..... H01P 1/161

[52] U.S. Cl. ..... 333/125; 333/126; 333/21 A; 333/33; 333/249; 333/251

[58] Field of Search ..... 333/125, 126, 135, 137, 333/21 A

[56] References Cited

U.S. PATENT DOCUMENTS

| | | | |
|---|---|---|---|
| 3,978,434 | 8/1976 | Mörz et al. | 333/21 A X |
| 4,162,463 | 7/1979 | Di Tullio et al. | 333/21 A X |
| 4,231,000 | 10/1980 | Schuegraf | 333/109 |
| 4,237,000 | 12/1980 | Read et al. . | |
| 4,270,107 | 5/1981 | Schuegraf . | |
| 4,293,829 | 10/1981 | Schuegraf . | |
| 4,504,805 | 3/1985 | Ekelman, Jr. et al. | 333/21 A X |
| 4,520,329 | 5/1985 | D'Oro et al. | 333/21 A X |

FOREIGN PATENT DOCUMENTS

| | | |
|---|---|---|
| 0147693 | 6/1984 | European Pat. Off. . |
| 2521956 | 11/1976 | Fed. Rep. of Germany . |
| 2747632 | 4/1979 | Fed. Rep. of Germany . |
| 2842576 | 4/1980 | Fed. Rep. of Germany . |
| 2842577 | 4/1980 | Fed. Rep. of Germany . |
| 3010360 | 9/1981 | Fed. Rep. of Germany . |
| 3208029 | 9/1986 | Fed. Rep. of Germany . |

*Primary Examiner*—Paul Gensler

*Attorney, Agent, or Firm*—Hill, Van Santen, Steadman & Simpson

[57] ABSTRACT

A polarization diplexer which branches from a circular or quadratic waveguide in the axial direction into pairs of rectangular waveguides respectively lying opposite each other with the first pair of two rectangular waveguides lying opposite one another and fed by a symmetrical hybrid junction comprising straight subarms and wherein the first pair are symmetrical. The second pair of rectangular waveguides comprises two rectangular waveguides lying opposite each other which is fed by a second electrically symmetrical hybrid junction having subarms straddled over their broad dimension. The invention can also be utilized as a polarization frequency diplexer.

11 Claims, 7 Drawing Figures

POLARIZATION SEPARATING FILTER FOR HYPER FREQUENCY STRUCTURES

BACKGROUND OF THE INVENTION

1. Field of the Invention

This invention relates in general to a polarization diplexer.

2. Description of the Prior Art

Microwave antennas which have band widths of 2:1 and more can be obtained using correspondingly broadband polarization diplexers for operation with two different polarizations. Such a polarization diplexer allows the combination with two frequency diplexers to form a polarization frequency diplexer which has been identified as a system diplexer that allows two radio link systems of adjacent frequency bands each having two linear polarizations to be switched into one and the same antenna. As compared to previous one band antennas, such two band antenna system has expanded transmission capacities for two radio links which is an advantage where limited space requirements occur on the radio tower.

Also, in satellite communication systems, transmission capacity can be increased by expanding the frequency ranges to extend above one octave, for example, 3.7 through 6.435 GHz up to the present time to 3.4 through 7.125 GHz in the future. Polarization diplexers which comprise useable frequency ranges of more than 2:1 and which avoid expensive ridge waveguides are not known in the prior art. Polarization diplexers such as described in U.S. Pat. No. 4,293,829 which comprise two E-plane offset sections and two H-plane offset sections as well as the polarization diplexer described in German OS No. 30 10 360 which comprise four E-H-plane offset sections also have a theoretical unambiguous frequency range of only 2:1; and this corresponds to a maximum useable frequency range of 1.73:1. The physical reasons for the fact that the unambiguous frequency range of such prior art polarization diplexers is limited towards higher frequencies is because in the H-plane bends they excite the $TE_{20}$ spurious mode starting with the operating frequency at which the $TE_{20}$ cutoff frequency is reached in the rectangular waveguide of the H-plane bend. As a consequence that $\lambda_{cTE20}=a$, the $TE_{20}$ cutoff frequency of a H-plane bend only depends on the broadside dimensions a of the waveguide; and $f_{cTE20}$ as well as the unambiguous frequency range $f_{cTE20}/f_{cTE10}$ remain unchanged as compared to the normal profile waveguide with $a=2b$ wherein the height b of the waveguide is reduced and a is retained constant. Also, both of H-plane bends as well as the H-plane corners exhibit the same behaviour.

SUMMARY OF THE INVENTION

It is an object of the present invention to eliminate the problems and difficulties of the prior art device and to provide a structure of a polarization diplexer in which there are no H- plane bends required.

The present invention provides a polarization diplexer for microwave frequencies comprising a five armed double branching arrangement which branches a circular or quadratic waveguide in the axial direction into two pairs of rectangular waveguides which respectively lie opposite each other and wherein the first pair composed of two rectangular waveguide arms (1, 3) of said double branching (DV) lying opposite one another is fed by a hybrid junction (gG) which is symmetrical and which comprises straight sub-arms and wherein the second pair of rectangular waveguides are composed of two rectangular waveguide arms (2, 4) of said double branching (DV) structure which lie opposite one another and is fed by a second hybrid junction (äG) which is electrically symmetrical and comprises sub-arms which are straddled over the broad sides of the waveguide.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure:

DESCRIPTION OF THE PREFERRED EMBODIMENTS

An E-plane bend which does not excite a $TE_{20}$ spurious mode is significantly better and desirable with respect to the broadband characteristics as compared to a H-plane bend structure which is described above. The $TM_{11}$ spurious mode is excited in the rectangular waveguide of the E-plane bend with the cutoff wave length $$\lambda_{cTM11} = \frac{2ab}{\sqrt{a^2 + b^2}} \tag{1}$$

where $\lambda_{cTM11}$ depends on a and b. The upper limit of the unambiguous frequency range is $f_{cTM11}$ and the lower frequency range limit is $f\lambda_{cTE10}$ when $\lambda_{cTE10}=2a$. Depending on the sidewall ratio a/b of the rectangular E-plane bend waveguide, the following equation results.

$$\frac{f_{cTM11}}{f_{cTE10}} = \sqrt{1 + \left(\frac{a}{b}\right)^2} \tag{2}$$

Figure 1:
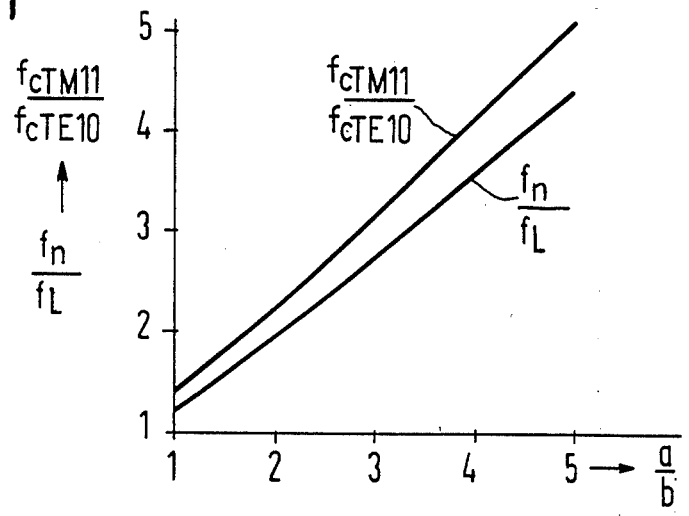
FIG. 1 is a graph illustrating the theoretical unambiguous frequency range $f_{cTM11}/f_{cTE10}$ and the practically useable frequency range f highest/f lowest of E-plane bends depending on the side wall ratio a/b of the rectangular waveguides.

According to equation 2 and as illlustrated in FIG. 1, $f_{cTM11}/f_{cTE10}$ of the E-plane bend becomes larger as the ratio a/b becomes larger and becomes lower as the ratio a/b becomes lower. As shown in FIG. 1, the practically maximum useable frequency range of an E-plane bend depending on the ratio a/b of the rectangular waveguide results from the theoretical unambiguous frequency range $f_{cTM11}/f_{cTE10}$ under the realistic assumption that the lowest operating frequency f is selected to be 10% above $f_{cTE10}$ and the highest operating frequency $f_h$ is selected to be 5% under $f_{cTM11}$.

An example of a E-plane bend structure which is frequently employed in prior art polarization diplexers is described in U.S. Pat. No. 4,293,829 in rectangular waveguides where a=4b which, for example, is useable free of spurious modes in the frequency range from 3.587 GHz through 12.773 GHz where a=46 mm. By contrast, the H-plane bends of the above mentioned diplexers can be used free of spurious modes from 3.587 GHz to only about 6.20 GHz with the same waveguide cross-section.

Figure 2:
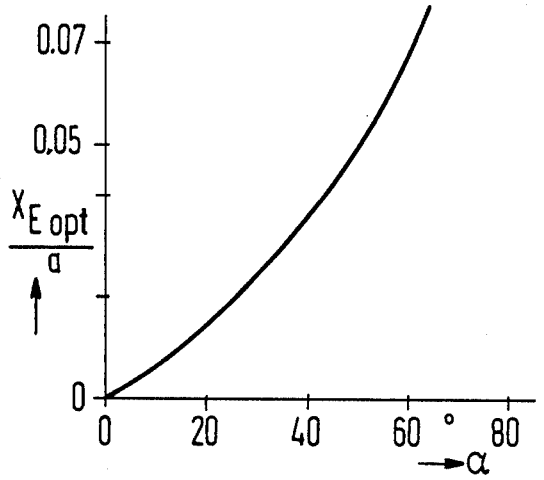
FIG. 2 is a graph illustrating the optimum corner bevelling for E-plane bends in rectangular waveguides where $a=4b$ plotted against the bend angle $\alpha$.
Figure 2A:
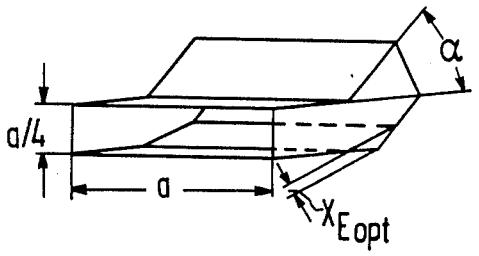
FIG. 2A is a perspective view of the waveguide structure illustrating the dimensions of the device.

As shall be shown below, the E-plane bend having dimension of a=4b is best suited as the main component for new broadband polarization diplexers. The broadband matching of such E-plane bend structures is therefore an important task. For this purpose, the known method of symmetrically bevelling the outside corner of the E-plane bend structure is utilized at first. As illustrated in FIG. 2 and FIG. 2A, the size of the corner bevelling is defined by the bevelling height $x_E$. FIG. 2 and FIG. 2A illustrate the bevelling height xhd Eopt which has been found for various bend angles $\alpha$ by measurements to achieve optimum broadband matching.

According to a further investigation, the reflection of E-plane bends at least in the bend angle range around 60° can be further decreased in a wide frequency range if E is chosen to be somewhat greater (such as 5 through 10% as compared to the values illustrated in FIG. 2) which results in overcompensation and a hollow space is formed in the diagonal intersection of the bevelling plane for example with a screw having a negative immersion depth into the waveguide.

As a practical example, a 60° E-plane bend is constructed with a=45.4 mm, b=11.35 mm and a screw-type M10 metrical is mounted in the diagonal intersection of the bevelling plane which is bent outwardly by 0.3 mm relative to the surface. The measured reflection factor of such bend is less than 0.7% in the frequency range from 3.7 GHz through 9.9 GHz. It is known for certain that the upper limit of 9.9 GHz is not caused by the E-plane bend but by the spurious modes of the measuring installation utilized. The upper frequency limit of the E-plane bend lies above 9.9 GHz and specifically $f_{cTM11}$=13.62 GHz according to equation (1).

As discussed above, E-plane bend structures having reduced waveguide height b are far superior as far as bandwidth and amount of reflection to corresponding H-plane bend structures. Thus, the inventor has considered the question of how a polarization diplexer can be optimally constructed using only E-plane bend structures having a reduced waveguide height b and homogenous lines without using any H-plane bends.

Figure 3A:
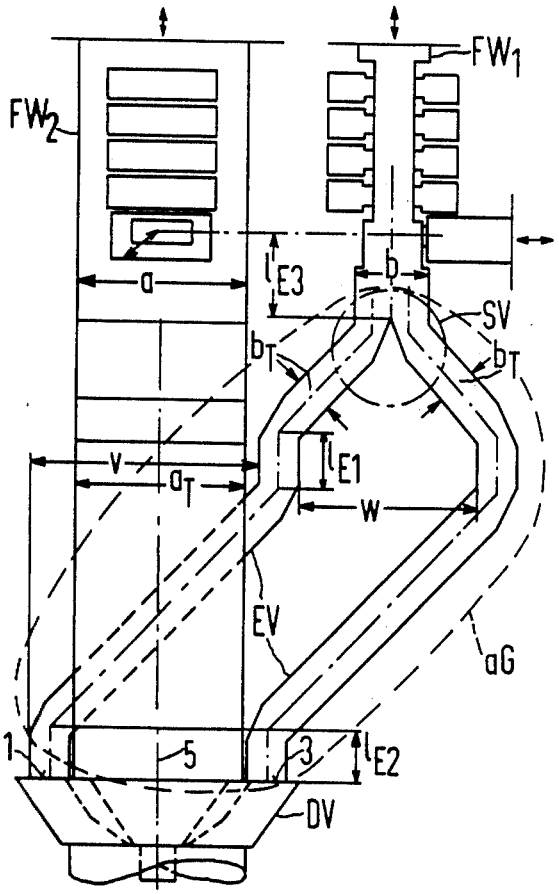
FIG. 3A is a first plan view illustrating in cross-section the polarization frequency diplexer through the straddled hybrid junction.
Figure 3B:
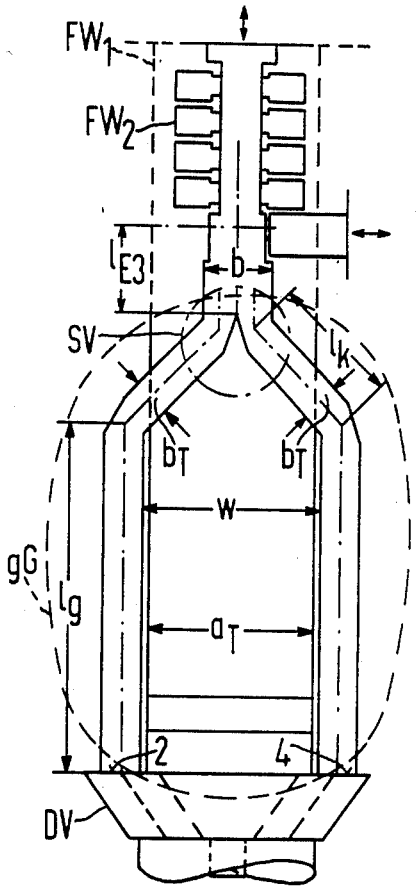
FIG. 3B illustrates the second mutually perpendicular cross-section through the polarization frequency diplexer through the straight hybrid junction.
Figure 5:
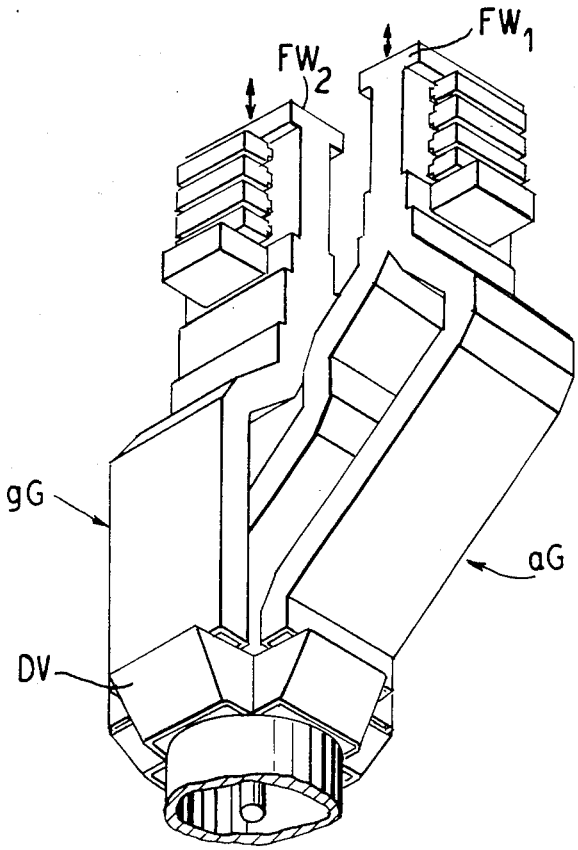
FIG. 5 is a perspective view of the invention.

A solution according to the invention is illustrated in FIGS. 3A and 3B and FIG. 5 using a double branching structure DV as illustrated in FIGS. 3A and 3B and as described in U.S. Pat. No. 4,293,829 Such double branching structure DV can be constructed with four waveguides as E-plane offset sections which are rotated respectively by 90° relative to each other and are symmetrically arranged around the circular waveguide axis. The four cyclically lying rectangular waveguides which have thus resulted are offset relative to the axis of the circular waveguide by using short ridge waveguide sections and feed into the circular waveguide in a broadbanded manner with low reflection.

So as to excite the mutually perpendicular linear $TE_{11}$ polarizations in the circular waveguide, two mutually opposite rectangular waveguide connections (1 and 3) and (2 and 4) of the double branching structure DV illustrated in FIG. 3A and FIG. 3B are to be fed with two subwaves of identical amplitude which have mutually opposite phase relative to the circular waveguide axis 5. As illustrated in FIG. 3B, a first rectangular hybrid junction gG having straight sub-arms which are symmetrically arranged and are illustrated bounded with broken lines and as illustrated in FIG. 3A second electrically symmetrical rectangular hybrid junction äG having two subarms straddled toward the right and are bounded with broken lines in FIG. 3A such that the left sub-arm 1 of the sub-arms 1 and 3 is mounted penetration-free between the straight arms 2 and 4 of the first hybrid junction gG.

Figure 4:
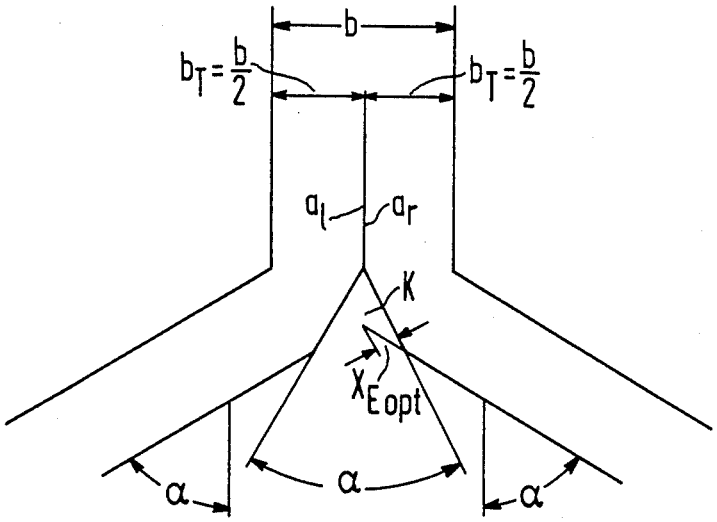
FIG. 4 is a plan view illustrating the dimensions of the broadband matched series branching structure SV.

In the example illustrated in FIGS. 3A and 3B, each of the hybrid junctions gG and äG are composed of a symmetrically rectangular waveguide series branching structure SV with, for example dimensions of a=2b, and they divide the rectangular waveguides to be branched in an impedance matched manner and with constant width dimensions of $a=a_T$, divides them into two subarms having the dimensions $a_T=4b_T$ and as illustrated in FIG. 4, such structure can be composed of two E-plane bends of the rectangular waveguide with $a_T=4b_T$. Thus, with a bend direction mutually opposite one another the two E-plane bends of the rectangular waveguide lie against one another with an extremely thin right and left broadside wall $a_r$ and $a_l$. When the thin guiding wall is omitted then the fields are not altered and as illustrated in FIG. 4, the wedge K having a tip angle $\alpha$ equal to the bend angle $\alpha$ extending over the entire broadside width remains and this also results in the bevelling height of $x_{Eopt}$ which is illustrated in FIG. 2 which has been defined above for the E-plane bend only and now also applies for the optimum broadband matching of the series branching. This shape of the series branching of the structure illustrated in FIG. 4 is particularly suitable for manufacturing using known numerical control milling methods.

According to FIGS. 3A and 3B, an E-plane bend in every sub-arm follows the series branching structure SV of both hybrid junctions and this E-plane bend has the same angle and opposite bend direction as the E-plane bend of the series branching respectively proceeding in the axis of the device. The spacing $l_k$ of successive E-plane bends is selected such that as shown in FIGS. 3A and 3B, the sub-arms extend parallel to one another and have the spacings w between their inwardly mounted broadside walls and the spacing w is somewhat greater than the broadside $a_T$ of the sub-arms.

The straight hybrid junction gG is completed in that its sub-arms illustrated in FIG. 3B are extended by straight rectangular waveguides having the length lg which is selected such that the straddled hybrid junction äG illustrated in FIG. 3A has space for free penetration between the sub-arms of the straight hybrid junction.

The straddled hybrid junction äG illustrated in FIG. 3A is completed in that two mutually identical E-plane offset sections EV having rectangular waveguide cross-section $a_T=4b_T$ are connected to the sub-arms of their series branching structures which extend parallel to each other. As illustrated in FIG. 3A, the E-plane offset section is composed of two mutually identical E-plane bends which are bent in opposite directions relative to each other and are connected by a homogenous line having a length such that an offset path V measured in the horizontal direction results which is adequate for the free penetration arrangement of both hybrid junctions.

It is important that the double branching of the straddled hybrid junction äG is only excited electrically in a symmetrical manner without causing spurious modes when as illustrated in FIG. 3A, the spacings $l_{E1}$ and $l_{E2}$ between neighboring E-plane bends are substantially large. The criteria for this is the well-known aperiodic attenuation $a_{apTM11}$ of the line sections having the length $l_{E1}$ or, respectively, $l_{E2}$ for the $TM_{11}$ spurious field excited by the E-plane bend at the critical highest operating frequency with free space wavelength $\lambda_0$. This is $$a_{apTM11} = \frac{2\pi l_E}{\lambda_{cTM11}} \sqrt{1 - \left(\frac{\lambda_{cTM11}}{\lambda_o}\right)^2} \; N_p \tag{3}$$

with $\lambda_{cTM11}$ from equation (1). Experience has taught $a_{apTM11}=20$ dB is sufficient at the highest operating frequencies for practically relevant bend angles of 50° through 60° and $a_T=4$ bT; 20 dB is achieved at short lengths $l_E \approx b_T$.

With the polarization diplexer illustrated in FIGS. 3A and 3B, the connection flanges of the polarization selective rectangular waveguides lie in one and the same plane. The electrical length of the straight hybrid junction gG is thus initially shorter than that of the straddled hybrid junction. At least at one operating frequency, it is possible to produce exactly identical electrical lengths of both paths of the polarization diplexer in that the straight hybrid junction gG is lengthened and consequently the straddled hybrid junction äG can be shortened for topological reasons. There is no concern that the phase symmetry has a greater frequency response because the electrical difference of the one polarization diplexer path relative to the other is slight and this difference is composed of the E-plane offset sections EV illustrated in FIG. 3A compared with the straight lines $l_g$.

The polarization diplexer illustrated in FIGS. 3A and 3B solves the above stated objects because only E-plane bends and homogeneous lines still occur as elements. As compared to the frequency range of known arrangements the useable frequency range of this polarization diplexer is considerably widened and presumably extends beyond one octave. The significant and essential fact is that the new polarization diplexer of FIGS. 3A and 3B no longer contains any H-plane bends at all which are required in the arrangement of U.S. Pat. No. 4,293,829.

The polarization diplexer illustrated in FIGS. 3A and 3B has the further property that the axis of all occurring waveguide sections lie in only two planes which are perpendicular to each other and which are selected as the plane of the drawings in FIGS. 3A and 3B for clear explanation. Since these planes are also perpendicular to the broadside walls of all of the respective waveguides and also intersect these broadside walls along their center lines, all respective waveguides can be divided free of transverse currents in these planes and therefore they will be free of such losses. The polarization diplexer can then be composed of only five parts which are the double branching structure DV, two mirror symmetrically identical halves of the straight section (gG) and of the straddled (äG) hybrid junction. Since the waveguide walls of all four hybrid junction halves are rectangular with reference to the intersection planes without exception all of the parts can be produced with an NC (Numerical Control) milling method and apparatus in an inexpensive manner.

The polarization diplexer illustrated in FIGS. 3A and 3B can be extended into a polarization frequency diplexer. For this purpose, both polarization selective rectangular waveguide connections of the polarization diplexer are connected as shown in the top portions of FIGS. 3A and 3B to one of two identical frequency diplexers $FW_1$ or, respectively, $FW_2$ which respectively conduct a lower frequency band through the entrance of the structure illustrated in FIGS. 3A at the top portion and previously deflects an upper frequency band toward the side. In FIGS. 3A and 3B at the top portion, the polarization frequency diplexer then has two polarization-selective entrances which are assigned to respectively one of the two mutually orthogonal linear polarizations of the lower frequency band and have two polarization selective entrances as shown in FIG. 3A entering from the front or, respectively, from the right for both polarizations of the upper frequency band. The polarization frequency diplexer contains these four separate accesses with a common circular waveguide entrance illustrated in FIGS. 3A and 3B at the bottom to which the two band antenna is to be connected. These four diplexer paths are extremely low-loss and low-reflection and each path is highly decoupled from all of the others.

The frequency diplexer FW is disclosed in detail in German OS No. 32 08 029. As illustrated in FIGS. 3A and 3B, the diplexers $FW_1$ and $FW_2$ is composed of a respective lateral branching for the upper frequency band and of a schematically shown stop band filter which extends upwardly in the upper portion of FIGS. 3A and 3B which blocks the upper frequency band and allows the lower frequency band to pass in a reflection free manner. It is important that the fundamental structure of these frequency diplexers be in agreement with the above-explained fundamental structure of the hybrid junction gG and äG of the polarization diplexer. In other words, this principle is also valid in the frequency diplexer in that the axis of the waveguides lie in one and the same plane and the broadside walls of all the waveguides are perpendicular to this plane and that this plane divides all waveguide broadside walls along their center lines. In other words, the intersection planes are free of transverse currents and therefore free of such losses and that all waveguides are cylindrical with respect to this plane. This intersection plane is combined with the above selected intersection plane of the upper hybrid junction. Thus, the complex frequency diplexer plus hybrid junction can be manufactured in an inexpensive manner and with high precision in one pass and without a seam in the NC milling machine and method. The complete polarization frequency diplexer is composed of only five discrete parts.

It should also be noted that in the interconnection between the polarization diplexer and the frequency diplexer in FIGS. 3A and 3B, a minimum spacing of $l_{E3}$ is necessary between the tip of the series branching and the frequency diplexer entrance of the upper frequency band which feeds laterally in the example of FIGS. 3A and 3B. According to equation (3), this line length must guarantee an adequately high aperiodic attenuation of the $TM_{11}$ spurious mode field which is excited by the laterally entering frequency diplexer entrance for the upper frequency band.

It should be noted that regarding the so-called stretched arrangement of the frequency diplexers relative to the polarization diplexer illustrated in FIGS. 3A and 3B that the frequency diplexers can also be arranged so as to angle off preferably of the broadside of the waveguide. The different structural alternatives of the frequency diplexer are described in German OS No. 32 08 020 which may be referred to for further description of the structures.

Although the invention has been described with respect to preferred embodiments, it is not to be so limited as changes and modifications can be made which are within the full intended scope of the invention as defined by the appended claims.

I claim as my invention:

1. A polarization diplexer for high frequency equipment comprising a five-armed double branching (DV) symmetrical structure which branches a circular waveguide which extends in the axial direction into two pairs of rectangular waveguides respectively arranged opposite to one another, characterized in that the first pair consisting of two rectangular waveguide arms (1, 3) of said double branching structure (DV) lying opposite to one another is fed by a hybrid junction (gG) which is symmetrical and which comprises straight sub-arms; and that the second pair consisting of two rectangular waveguide arms (2, 4) of said double branching strucuture (DV) lying opposite to one another is fed by a second hybrid junction (äG) which is electrically symmetrical and comprises sub-arms straddled over its broad sides and all bends are constructed so as to be E-bends, characterized in that the two hybrid junctions (gG,äG) are each constructed with a symmetrical series branching structure (SV), wherein two respective E-plane bends are connected to the respective series branching structure (SV), said E-plane bends being designed and located such that the sub-arms of the hybrid junction structures (gG,äG) extend parallel to one another and the spacing (w) between the inwardly disposed broad walls of said sub-arms of said straight hybrid junction structure (gG) is somewhat greater by approximately 10% than the broad side dimension ($a_T$) of the sub-arms, and wherein two E-plane offset sections are formed with longitudinal axes exteding parallel to each other and are connected to the sub-arms of said series branching structure (SV) of said second hybrid junction (aG), said E-plane offset sections being each composed of two E-plane bends which have mutually opposite bend directions and are connected to each other with a homogenous line of a length such that an offset path (v) measured perpendicular to the longitudinal axis (5) of said double branching structure (DV) results and thepenetration-free arrangement of both hybrid junction structure (gG,äG) results.

2. A polarization diplexer according to claim 1, characterized in that, the $TM_{11}$ spurious field attenuation ($a_{apTM11}$), and the mutual spacings ($l_{E1}$,$l_{E2}$) of nieghboring E-plane bends are sufficiently large for the highest operating frequency which is to be used.

3. A polarization diplexer according to claim 2 characterized in that said E-plane bends are formed with symmetrical corners which are bevelled and a screw extends into said E-plane bends at the diagonal intersection of the bevelling plane whereby the bevelling height dimension of the respective corner bevelled portions is selected for optimum broadband matching.

4. A polarization diplexer according to claim 2, characterized in that each hybrid junction (gG, äG) is mechanically separated by one plane which is perpendicular to the broad side walls of all of the waveguides and intersects the broad side walls along their center lines.

5. A polarization diplexer according to claim 1, characterized in that said series branching structures (SV) are matched with sub-arms which have a side wall ratio of about $a_T=4b_T$, the respectively normal profile waveguide having roughly a=2b.

6. A polarization diplexer according to claim 5, characterized in that the length ($l_g$) of said sub-arms of said straight hybrid junction (gG) extends such and the offset path (v) of said hybrid junction (äG) is reduced such that identical electrical lengths result for both through branches of said polarization diplexer at a selected frequency.

7. A polarization diplexer according to claim 5, characterized in that said series branching structure (SV) has a wedge (K) which extends over the entire broad side ($a_T$), the peak angle ($\alpha$) of said wedge being equal to the bend angle ($\alpha$) of said series branching structure and the bevelling height dimension ($X_E$opt) is selected for optimum broadband matching, and a screw extends into said branching structure or a hollow space formed in the diagonal intersection of both rectangular wedge surfaces.

8. A polarization diplexer according to claim 7, characterized in that the length ($l_g$) of said sub-arms of said straight hybrid junction structure (gG) and the offset path (v) of said hybrid junction (äG)a are selected such that the two polarization-selective connection flanges of said polarization diplexer lie in the same plane.

9. A polarization diplexer according to claim 5, characterized in that a frequency diplexer (FW) is connected to both polarization-selective rectangular waveguide entrances.

10. A polarization diplexer according to claim 9, characterized in that the transverse-current-free intersection planes of said frequency diplexers (FW) coincide with the transverse-current-free intersection planes of the respectively associated hybrid junction (gG or, respectively, äG).

11. A polarization diplexer according to claim 10, characterized in that the spacing ($l_E$3) between the wedge tip of said series branching structure (SV) of the respective rectangular waveguide connection of said polarization diplexer and the laterally entering frequency diplexer opening for the upper frequency band is sufficiently large in consideration of $TM_{11}$ spurious mode field attenuation ($a_{apTM11}$) at the highest operating frequency.

* * * * *